US005311270A

United States Patent [19]

Urakawa

[11] Patent Number: 5,311,270

[45] Date of Patent: May 10, 1994

[54] PAPER CASSETTE HAVING A PLURALITY OF SWITCHES FOR SELECTING AN INPUT DATA PORT

[75] Inventor: Toshio Urakawa, Yamatokoriyama, Japan

[73] Assignee: Sharp Kabushiki Kaisha, Osaka, Japan

[21] Appl. No.: 71,758

[22] Filed: Jun. 9, 1993

[30] Foreign Application Priority Data

Jun. 10, 1992 [JP] Japan ..... 4-150939

[51] Int. Cl.[5] ..... G03G 21/00

[52] U.S. Cl. ..... 355/308; 346/134; 355/202; 355/311

[58] Field of Search ..... 355/308, 309, 311, 321, 355/201, 202, 316, 317; 271/9; 346/134, 146

[56] References Cited

FOREIGN PATENT DOCUMENTS 62-55142B2 11/1987 Japan .

*Primary Examiner*—A. T. Grimley

*Assistant Examiner*—Nestor R. Ramirez

*Attorney, Agent, or Firm*—David G. Conlin; Robert F. O'Connell

[57] ABSTRACT

A printer having a plurality of data input ports for printing out information input through each data input port on paper fed by a paper feeding device. The printer includes a main body; paper cassettes for storing the paper therein, each paper cassette made detachable from the main body; a plurality of setting portions to be set so as to direct whether or not each paper cassette is to be used for printing out information input through a predetermined data input port, the plurality of setting portions being provided for each paper cassette; a plurality of sensors for detecting the content of the setting portions when each paper cassette is installed in the main body; and a control section for, when printing out information input through each of the plurality of data input ports, controlling the paper feeding device to feed the paper within each paper cassette which is assigned for each data input port, based on results of the detection by the plurality of sensors.

5 Claims, 5 Drawing Sheets

PAPER CASSETTE HAVING A PLURALITY OF SWITCHES FOR SELECTING AN INPUT DATA PORT

BACKGROUND OF THE INVENTION

1. Field of the Invention

The present invention relates to a printer having a plurality of data input ports (hereinafter, referred to as DIPs) and being capable of printing out information input through each DIP.

2. Description of the Related Art

A high-speed type printer is usually equipped with a plurality of DIPs, and is capable of printing out information input through each DIP. Accordingly, such a printer can be shared by different administrative departments, so as to curtail costs and save space for installation thereof, etc.

Such a printer as described above is usually equipped with a plurality of paper cassettes; information is printed out on paper fed from each paper cassette. More specifically, information input through each DIP is printed out on paper fed from a paper cassette which is selected either arbitrarily or according to the size of the paper stored therein. In other words, in printing out information, the paper within a paper cassette is used without specifying which DIP the information derives from.

As a result, it is impossible to separately determine the amount of paper used for printing out information input through each DIP. This results in a problem that, in the case where several administrative departments share a printer, the amount of paper used by each department cannot be determined, making it impossible to accurately split costs among the administrative departments in proportion to the amount of paper used by each administrative department.

SUMMARY OF THE INVENTION

A printer according to the present invention, having a plurality of data input ports for printing out information input through each data input port on paper fed by a paper feeding device, comprises: a main body; paper cassettes for storing the paper therein, each of the paper cassettes being made detachable from the main body; a plurality of setting portions to be set so as to direct whether or not each of the paper cassettes is to be used for printing out information input through a predetermined data input port, the plurality of setting portions being provided for each of the paper cassettes; sensor means for detecting the content of the setting portions when each of the paper cassettes is installed in the main body; and means for, when printing out information input through each of the plurality of data input ports, controlling the paper feeding device to feed the paper within each of the paper cassettes which is assigned for each data input port, based on results of the detection by the sensor means.

In one embodiment of the invention, each of the paper cassettes has a side on which a plurality of slide knobs slidable between a first position and a second position are provided, and the plurality of setting portions are the plurality of slide knobs, respectively.

In another embodiment of the invention, the sensor means detects whether each of the plurality of slide knobs is in the first position or in the second position.

In another embodiment of the invention, the sensor means is a plurality of switching measures, each of which is conductive when a corresponding one of the plurality of slide knobs is in the first position, and is non-conductive when the corresponding one of the plurality of slide knobs is in the second position.

In another embodiment of the invention, each of the plurality of switching measures comprises: a substrate provided in the main body; a leaf spring loaded away from the substrate, one end thereof being fixed to the substrate; and a micro switch having a convex part, provided on the substrate, the micro switch becoming conductive when the convex part is pressed by the leaf spring, wherein when the corresponding one of the plurality of slide knobs is in the first position, the corresponding one of the plurality of slide knobs moves the leaf spring toward the substrate so that the leaf spring presses the convex part of the micro switch, and when the corresponding one of the plurality of slide knobs is in the second position, the corresponding one of the plurality of slide knobs stays out of touch with the leaf spring.

Thus, the invention described herein makes possible an advantage of providing a printer which makes it possible to determine the amount of paper used for printing out information input through each DIP in the case where a plurality of DIPs are incorporated.

This and other advantages of the present invention will become apparent to those skilled in the art upon reading and understanding the following detailed description with reference to the accompanying figures.

BRIEF DESCRIPTION OF THE DRAWINGS

FIGS. 6-1 and 6-2 are flow charts showing operations of the control section.

DESCRIPTION OF A PREFERRED EMBODIMENT

Hereinafter, an example of the present invention will be described with reference to the accompanying drawings.

Figure 1:
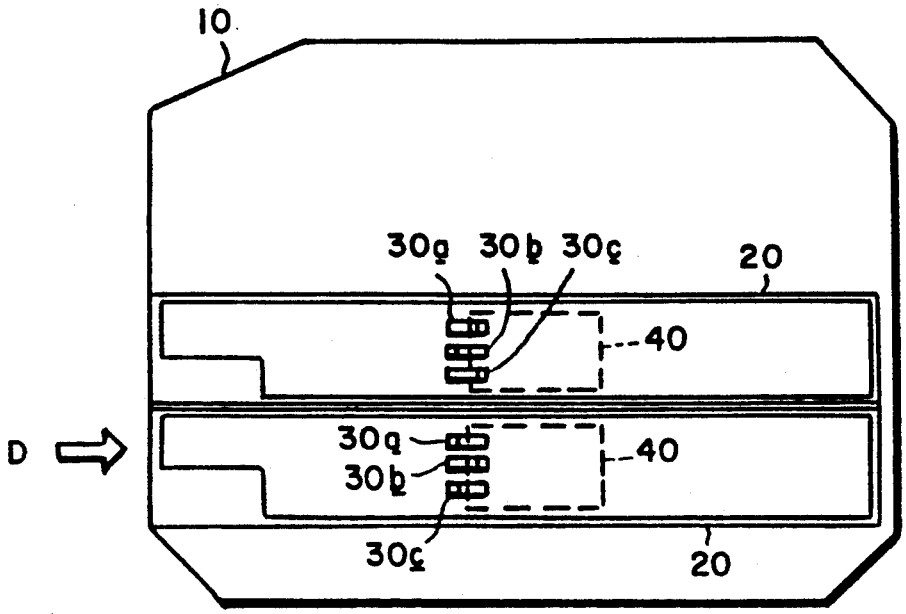
FIG. 1 is a schematic side view showing a configuration of a printer according to the present invention.

A printer of the present invention comprises a pair of paper cassettes 20 that are to be installed one over the other within a main body 10, as is shown in FIG. 1. A predetermined size of paper is stored in each paper cassette 20, and is selectively fed to the main body 10, which in turn prints an image thereon based on information input through one of three DIPs A to C (not shown) incorporated in the main body 10.

Figure 2:
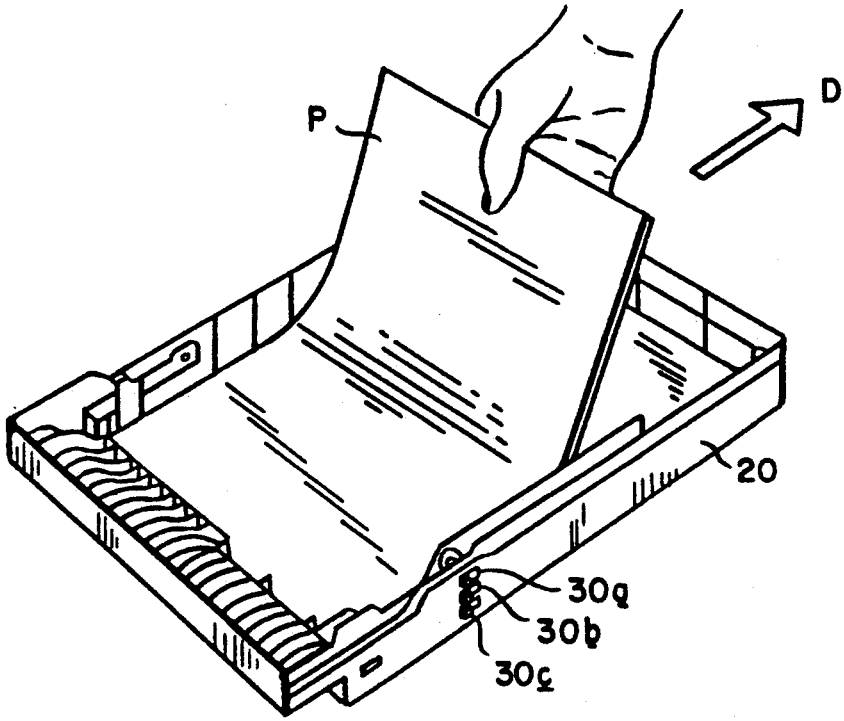
FIG. 2 is a perspective view showing a paper cassette incorporated in the printer of FIG. 1.

Each paper cassette 20 accommodates a plurality of paper sheets P, as is shown in FIG. 2, and is installed in a predetermined part of the main body 10 by being inserted in the direction (hereinafter, referred to as "insertion direction") shown by arrow D in FIGS. 1 and 2. On one side face of each paper cassette 20 are three setting portions 30*a* to 30*c* disposed one over another.

Figure 3:
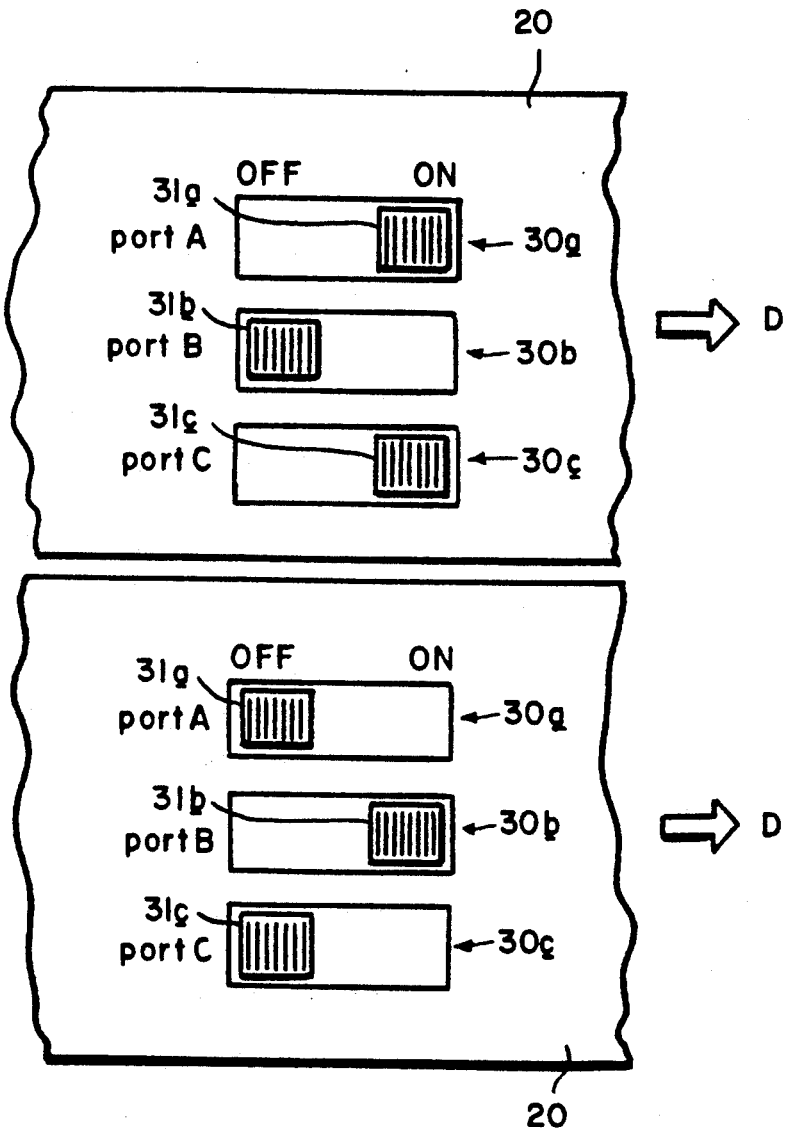
FIG. 3 is an enlarged view showing setting portions provided for each paper cassette.

As is shown in FIG. 3, the setting portions 30*a* to 30*c* comprise slide knobs 31*a* to 31*c*, respectively, which can independently be slid back and forth along the insertion direction.

Figure 4:
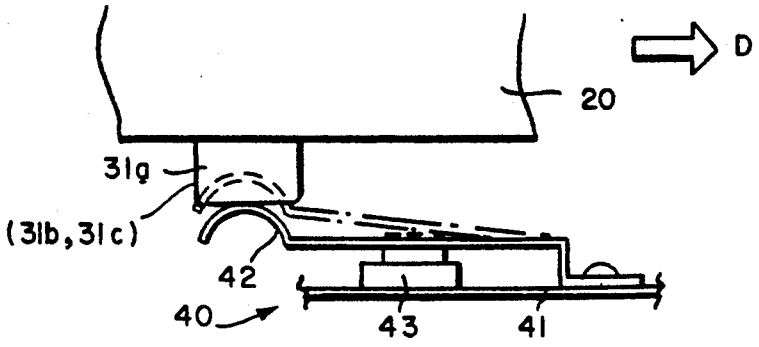
FIG. 4 is a plane view showing a sensor in a main body 10 of the printer, a paper cassette being installed therein.

In the main body 10, six sensors 40 are incorporated so as to oppose the setting portions 30*a* to 30*c* provided on the side faces of the two paper cassettes 20, as is shown in FIG. 4. Each sensor 40 comprises a circuit substrate 41 disposed so as to oppose the side of each paper cassette 20 upon which setting portions 30*a* to 30*c* are provided, a leaf spring 42 attached to a side of the circuit substrate 41 so as to oppose the above-mentioned side of each paper cassette 20, and a micro switch 43 to be activated by the leaf spring 42. Herein the leaf spring 42 extends along the circuit substrate 41, and an end thereof, toward which the paper cassette 20 is inserted, is attached to the circuit substrate 41. The tip (opposite to the end attached to the circuit substrate 41) of the leaf spring 42 is loaded away from the circuit substrate 41, as shown by the two-dot chain line in FIG. 4, and, in such a state, the micro switch 43 is in an off-mode, i.e. not activated.

In the case where the slide knobs 31*a* to 31*c* are slid to the front ends (i.e. the right ends in the figure) of the setting portions 30*a* to 30*c* in the insertion direction, upon installing the paper cassette 20 in the main body 10, each of the slide knobs 31*a* to 31*c* comes in contact with the tip of the leaf spring 42 in each sensor 40. This causes each leaf spring 42 to pivot toward the circuit substrate 41, putting each micro switch 43 in an on-mode.

Each of the slide knobs 31*a* to 31*c* is to be set at either end, along the insertion direction, of each of the setting portions 30*a* to 30*c*, so as to direct which paper cassette 20 is to be used for printing out information input through any of the DIPs A to C incorporated in the main body 10.

For example, the case will be described below where paper stored in the lower paper cassette 20 is directed so as to be used for printing out information input through the DIP B:

As is shown in FIG. 3, in the lower paper cassette 20, the slide knob 31*b* of the setting portion 30*b* (which corresponds to the DIP B) is disposed in the middle of the vertical direction and is set in the on-position, i.e. the front end in the insertion direction. At the same time, the respective slide knobs 31*a* and 31*c* of the setting portions 30*a* and 30*c* (which correspond to the DIPs A and C respectively) which are disposed above and below the setting portion 30*b*, respectively, are set in the off-position, i.e. the back end in the insertion direction of the lower paper cassette 20.

Furthermore, in the upper paper cassette 20, in order that the upper paper cassette 20 be used for printing out information input through the DIPs A and C, the slide knob 31*b* of the setting portion 30*b* (which corresponds to the DIP B) is disposed in the middle and is set in the off-position i.e. the back end in the insertion direction. At the same time, the respective slide knobs 31*a* and 31*c* of the setting portions 30*a* and 30*c* (which correspond to the DIPs A and C respectively) which are disposed above and below the setting portion 30*b*, respectively, are set in the on-position, i.e. the front end in the insertion direction. As a result, the micro switches 43 in the three sensors 40 for each paper cassette 20 are operated according to the positions of the slide knobs 31*a* to 31*c* of the setting portions 30*a* to 30*c*.

Figure 5:
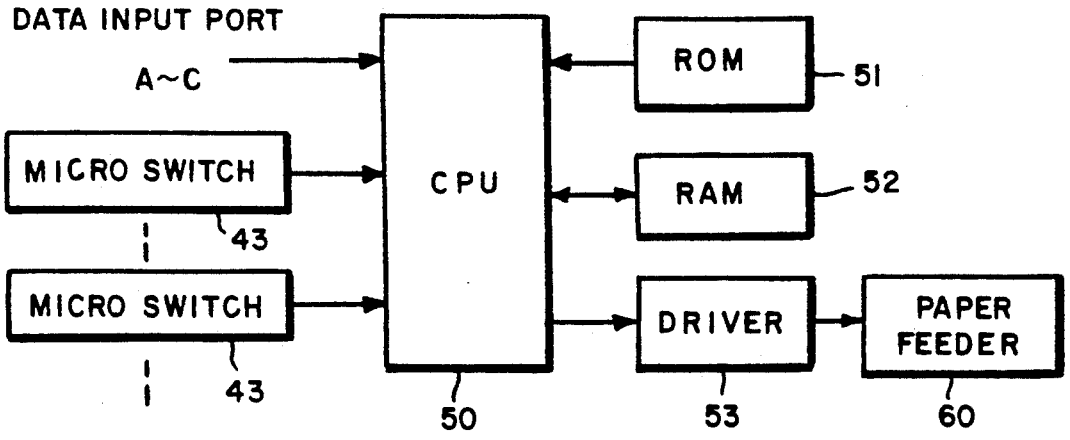
FIG. 5 is a block diagram showing an essential part of a control section incorporated in the printer of FIG. 1.

FIG. 5 is a block diagram showing an essential part of a control section incorporated in the main body 10. The control section comprises a CPU 50, to which information from the DIPs A to C installed in the main body 10 is input. The CPU 50 receives output of the six micro switches 43 corresponding to the setting portions 30*a* to 30*c* of the two paper cassettes 20, and performs predetermined operations while exchanging signals with a RAM 52, based on a procedure stored in a ROM 51. Output of the CPU 50 is received by a paper feeder 60 via a driver 53. The paper feeder 60 selects one of the paper cassettes 20. Paper stored in the selected paper cassette 20 is fed to the main body 10.

Figures 1, 6:
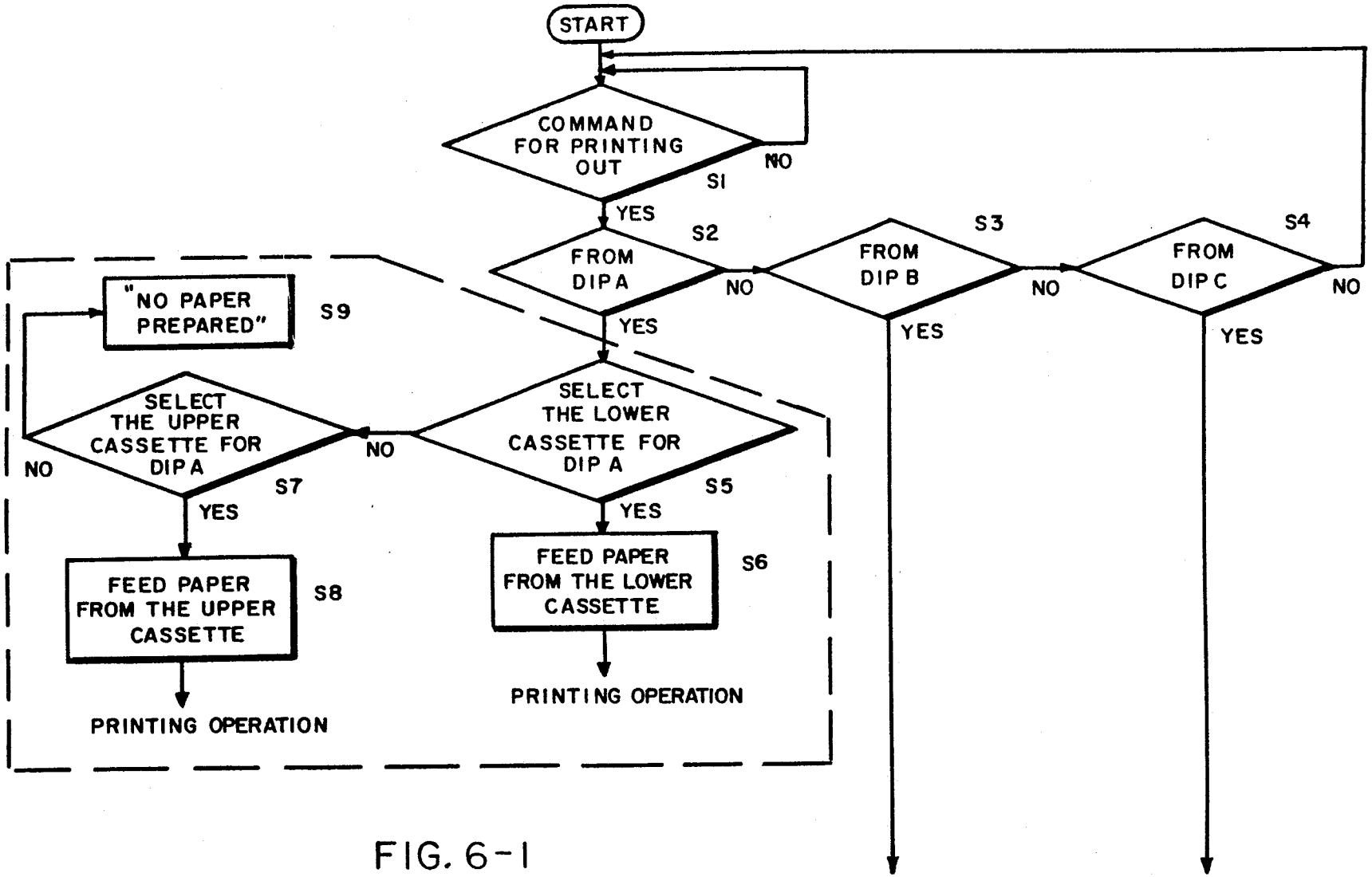
Figures 2, 6:
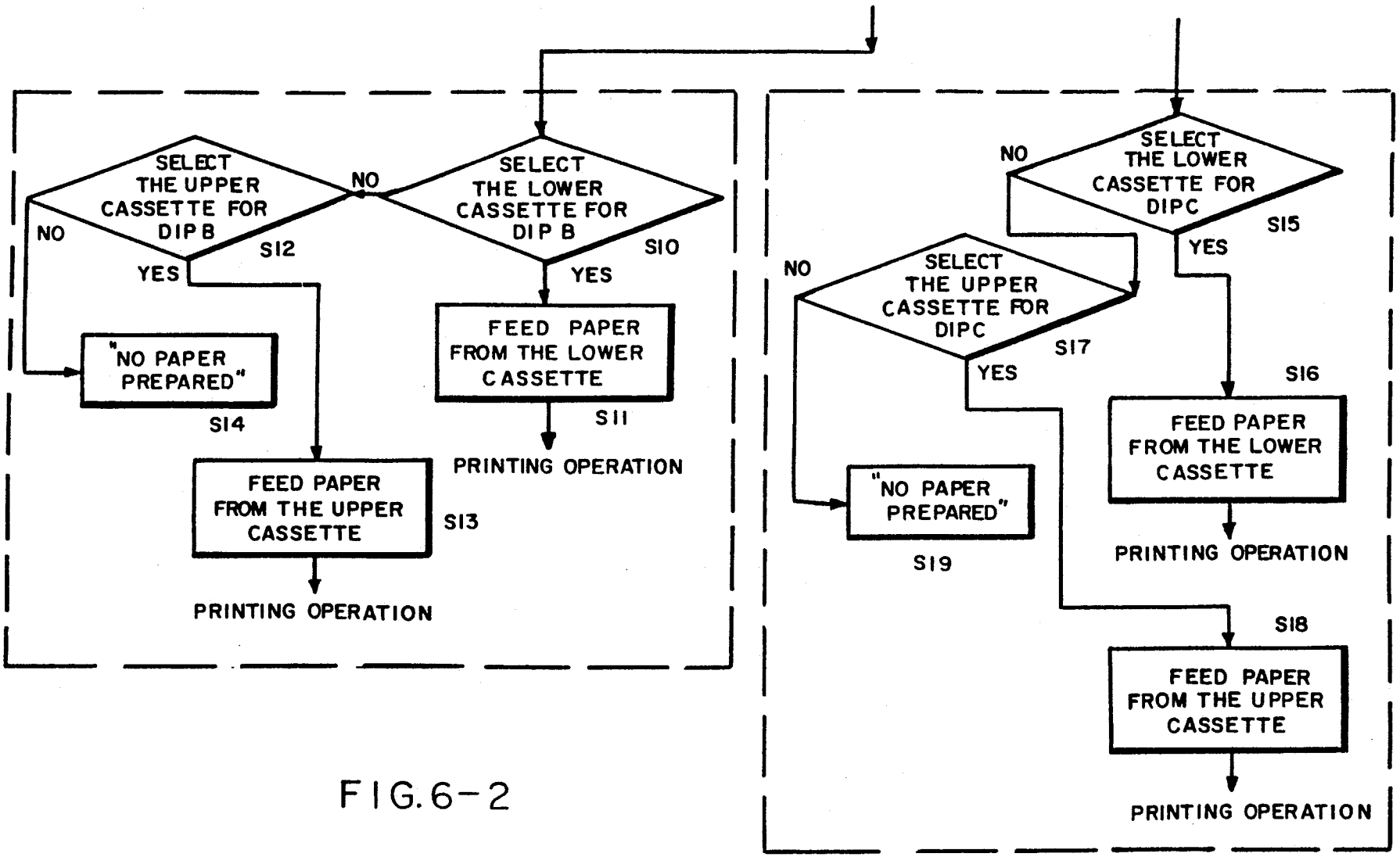

FIG. 6-1 and 6-2 show a flow of control made by the CPU 50. The CPU 50 waits until it receives a command for printing out information from any of the DIPs A to C (step S1). Upon receiving such a command, a judgment is made as to which DIP the information was input through (steps S2 to S4).

In the case where the command orders that information input through the DIP A be printed out, the following is performed: First, a judgment is made as to whether or not the lower paper cassette 20 is set so as to be used for printing out information from the DIP A, based on output of each micro switch 43 corresponding to the lower paper cassette 20 (step S5). If the lower paper cassette 20 is indeed selected for printing out information from the DIP A, the paper feeder 60 is driven so as to feed paper stored in the lower paper cassette 20 to the main body 10 (step S6). Then, the main body 10 performs the predetermined printing operations on the paper thus fed so that the information input through the DIP A is printed thereon.

On the contrary, if the lower paper cassette 20 is not selected for printing out information input through the DIP A, a judgment is made as to whether or not the upper paper cassette 20 is selected for printing out information input through the DIP A (step S7). If the upper paper cassette 20 is indeed selected, the paper feeder 60 is driven so as to feed paper stored in the upper paper cassette 20 to the main body 10 (step S8) so that the information input through the DIP A is printed thereon.

Furthermore, if the upper paper cassette 20 is not selected either, for example, a sign that says "No paper prepared" is displayed on the main body 10 (step S9).

As has been described, in the case where information input through the DIP A is to be printed out, either of the paper cassettes 20 so set as to be used for the DIP A feeds paper to the main body 10 so that the information is printed thereon.

In the present example, information input through the DIP A is printed out on the paper fed from the upper paper cassette 20, which is so set as to be used for the DIP A. Likewise, information input through the DIP B is printed out, by a similar procedure, on the paper fed from the lower paper cassette 20 (steps S10 to S14), which is set so as to be used for the DIP B. Likewise, by a similar procedure, information input through the DIP C is printed out on the paper fed from the upper paper cassette 20 (steps S15 to S19), which is set so as to be used for the DIP C.

Since the lower paper cassette 20 is used exclusively for printing out information input through the DIP B, the number of paper sheets consumed for printing out information input therethrough can be counted simply by counting the number of paper sheets consumed from the lower paper cassette 20. Therefore, in the case where several administrative departments share a printer and each department is assigned with a DIP, it is possible to keep under control the number of paper sheets used by each department, simply by setting each paper cassette 20 so as to be used for each DIP and counting the number of paper sheets consumed from each paper cassette.

As has been described, a printer according to the present invention has an advantage that, since information input through each DIP is printed out on paper within a paper cassette which has previously been assigned for that DIP, it is made easy to keep under control the number of paper sheets used for printing out information input through each DIP.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A printer having a plurality of data input ports for printing out information input through each data input port on paper fed by a paper feeding device, comprising:

a main body;

paper cassettes for storing the paper therein, each of the paper cassettes being made detachable from the main body;

a plurality of setting portions to be set to direct whether or not each of the paper cassettes is to be used for printing out information input through a predetermined data input port, the plurality of setting portions being provided for each of the paper cassettes;

sensor means for detecting the content of the setting portions when each of the paper cassettes is installed in the main body; and means for, when printing out information input through each of the plurality of data input ports, controlling the paper feeding device to feed the paper within each of the paper cassettes which is assigned for each data input port, based on results of the detection by the sensor means.

2. A printer according to claim 1, wherein each of the paper cassettes has a side on which a plurality of slide knobs slidable between a first position and a second position are provided, and the plurality of setting portions are the plurality of slide knobs, respectively.

3. A printer according to claim 2, wherein the sensor means detects whether each of the plurality of slide knobs is in the first position or in the second position.

4. A printer according to claim 2, wherein the sensor means is a plurality of switching means, each of which is conductive when a corresponding one of the plurality of slide knobs is in the first position, and is non-conductive when the corresponding one of the plurality of slide knobs is in the second position.

5. A printer according to claim 4, wherein each of the plurality of switching means comprises:

a substrate provided in the main body;

a leaf spring loaded away from the substrate, one end thereof being fixed to the substrate; and a micro switch having a convex part, provided on the substrate, the micro switch becoming conductive when the convex part is pressed by the leaf spring, wherein when the corresponding one of the plurality of slide knobs is in the first position, the corresponding one of the plurality of slide knobs moves the leaf spring toward the substrate so that the leaf spring presses the convex part of the micro switch, and when the corresponding one of the plurality of slide knobs is in the second position, the corresponding one of the plurality of slide knobs stays out of touch with the leaf spring.

* * * * *